US005181830A

United States Patent [19]

Chou

[11] Patent Number: 5,181,830

[45] Date of Patent: Jan. 26, 1993

[54] BLADE FOR AXIAL FLOW FAN

[76] Inventor: Rudy S. Chou, 87 Ingleside La., Liverpool, N.Y. 13090

[21] Appl. No.: 796,514

[22] Filed: Nov. 21, 1991

[51] Int. Cl.[5] ..... F01D 5/14

[52] U.S. Cl. ..... 416/223 R; 416/236 A

[58] Field of Search ..... 416/223 R, 223 A, 228, 416/236 A

[56] References Cited

U.S. PATENT DOCUMENTS

| | | | |
|---|---|---|---|
| 2,068,792 | 1/1937 | Dekker | 416/228 |
| 2,426,742 | 9/1947 | Pawlowski | 416/236 A |
| 3,294,315 | 12/1966 | Stewart et al. | 416/228 |
| 4,893,990 | 1/1990 | Tomohiro et al. | 416/223 R |
| 5,064,346 | 11/1991 | Atarashi et al. | 416/223 B |

FOREIGN PATENT DOCUMENTS

| | | | |
|---|---|---|---|
| 426988 | 3/1926 | Fed. Rep. of Germany | 416/223 R |
| 1097285 | 1/1961 | Fed. Rep. of Germany | 416/236 A |
| 1195474 | 11/1959 | France | 416/228 |
| 490239 | 11/1938 | United Kingdom | 416/228 |

*Primary Examiner*—John T. Kwon

[57] ABSTRACT

An axial flow fan blade (11) having an enhanced tip (12, 12') to reduce or eliminate tip vortices and therefore vortex induced noise. The enhancement is a rounded body extending from the blade tip and having faired ends (15, 16) but otherwise a generally circular cross section. The body conforms to the contour of the tip and extends from the leading to the trailing edge of the blade. The body may have either a generally constant cross section (12) or a cross section that decreases from its leading to its trailing end (12').

1 Claim, 2 Drawing Sheets

BLADE FOR AXIAL FLOW FAN

BACKGROUND OF THE INVENTION

This invention relates generally to axial flow or propeller type fans. More specifically, the invention relates to a fan blade having an enhancement at its tip that is effective in reducing or preventing separated air flow around the blade tip and thus reduces radiated noise from the fan.

Axial flow fans are widely used to move air in a great many applications. Such fans are common in heating, ventilation, air conditioning and refrigeration systems. A primary objective in the design of most fans is to reduce the noise produced by the fan when it is in operation.

As an axial flow fan moves air, and due to the pressure difference between them, air moves from the pressure surface to the suction surface of the blade over the blade tip. The flow forms a vortex on the suction side of the blade in the region of the blade tip. Within the core of the vortex the air is turbulent. One source of the turbulence is the flow separation caused by the sudden reversal of the air flow around the relatively sharp tip of the fan blade. The interaction between the turbulent air in the core of the vortex and the blade tip is a source of air flow noise from the fan.

What is needed is a means of reducing the tip vortices on the blades of an axial flow fan in order to reduce the interaction between vortex and blade tip and thus reduce fan radiated noise.

SUMMARY OF THE INVENTION

The present invention is an axial flow fan blade having an enhancement at its tip. The enhancement is generally circular in cross section and faired at each of its ends. In one embodiment, the overall shape of the enhancement is generally cylindrical but curved to conform to an arc of the circumference of the swept disk of the fan, while in another embodiment the enhancement has a generally conical shape also curved to follow a circumferential arc.

The enhancement reduces blade suction surface tip vortices by reducing the separated air flow around the blade tip and by increasing the effective radius of the tip, which results in a more gradual pressure gradient from the suction to the pressure surface of the blade.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
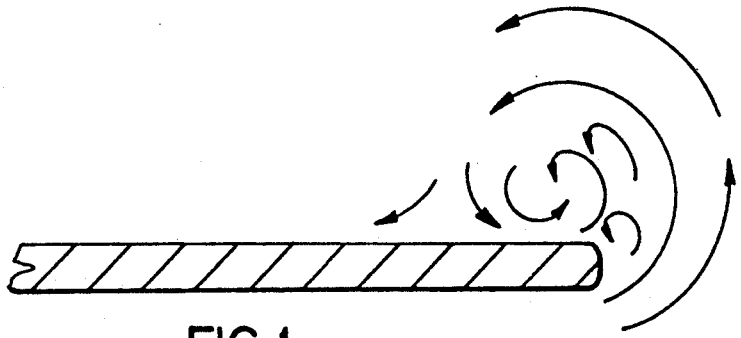
FIG. 1 Prior Art
FIG. 1 is a sectioned view of the tip of a prior art axial flow fan blade.

FIG. 1 depicts the tip of the blade of a prior art axial flow fan in operation. The flow arrows in the figure show the flow of air around the blade tip from the pressure surface to the suction surface of the blade. The arrows show that a vortex is formed on the suction surface near the blade tip as the blade moves through the air. The air at the center of the vortex is turbulent because of the flow separation from the blade as the air flow reverses direction from the pressure surface to the suction surface. The interaction between the blade tip and the turbulent air in the vortex is a source of radiated noise from the fan.

Figure 2:
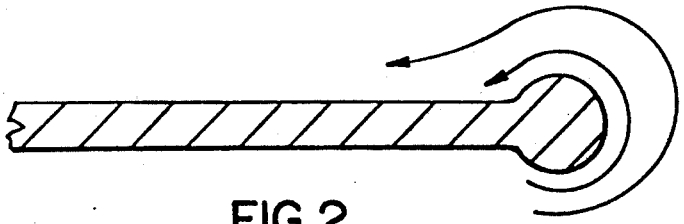
FIG. 2 is a sectioned view of the tip of an axial flow fan blade tip having a tip enhancement.

FIG. 2 depicts the tip of the blade of an axial flow fan having an enhancement as the fan is in operation. The rounded enhancement at the blade tip reduces flow separation at the blade tip. The blade tip enhancement also reduces the pressure gradient along the air flow path by increasing the distance the air must travel from the pressure surface to the suction surface of the blade. As shown by the flow arrows in the figure, the result is a reduction or elimination of the tip vortex on the blade and a reduction or elimination of that portion of radiated noise from the fan that is due to interaction between the blade tip and the vortex.

Figure 3:
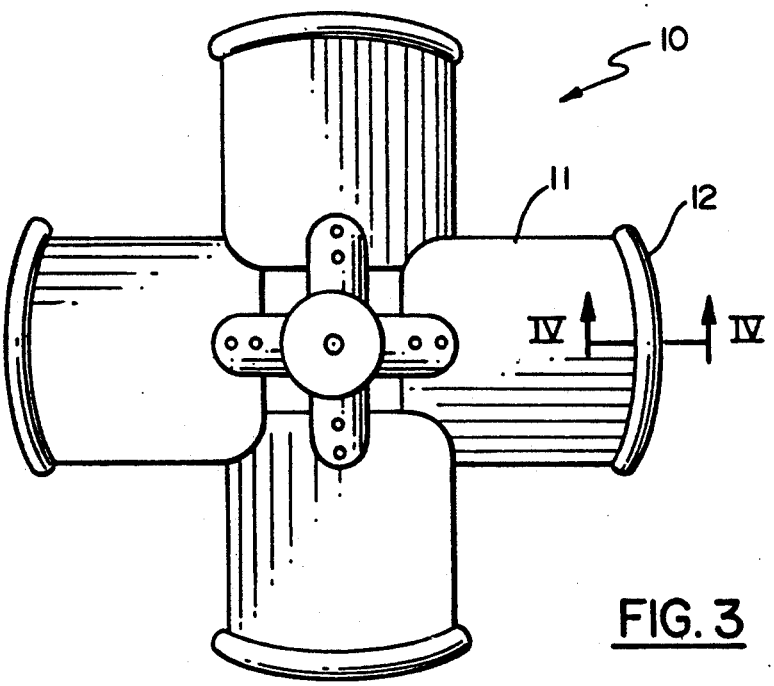
FIG. 3 is a view of an axial flow fan having blades with enhancements according to one embodiment of the present invention.
Figure 4:
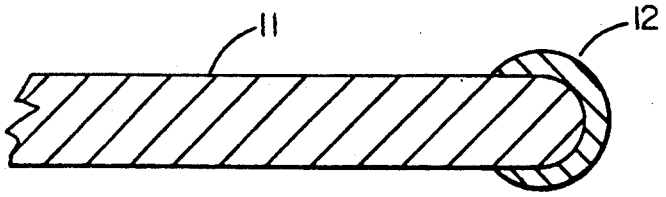
FIG. 4 is a view of a section, through line IV—IV in FIG. 3, of a fan blade tip having a blade tip enhancement of the present invention.
Figure 5:
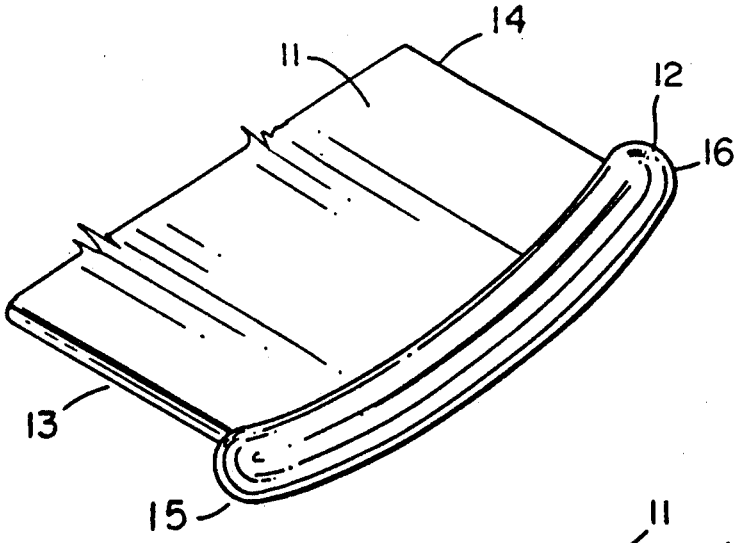
FIGS. 5 and 6 are isometric views of the tips of fan blades having enhancements according to two different embodiments of the present invention.

FIG. 3 is a view of an axial flow fan 10 having a blade 11 with an enhancement according to one embodiment of the present invention. The enhancement is body 12 extending generally from blade leading edge 14 to blade trailing edge 13 at the blade tip. A sectioned view of the tip of blade 11 and body 12 is shown in FIG. 4. FIG. 5 depicts an isometric view of blade 11 and body 12. Axial flow fans generally have two or more identical blades. All the blades of a given fan should have enhancements as is shown in FIG. 3. Body 12 may either be a separate part affixed to blade 11 or both members may be manufactured as a single piece, as where the fan is molded from a plastic material.

In the plane of the disk swept by fan 10, body 12 is curved to conform to an arc of the circumference of that disk. In planes passing through the axis of rotation of fan 10, body 12 has a generally circular cross section that is generally constant for the length of body 12 except for leading end 16 and trailing end 15, both of which are aerodynamically faired.

Figure 6:
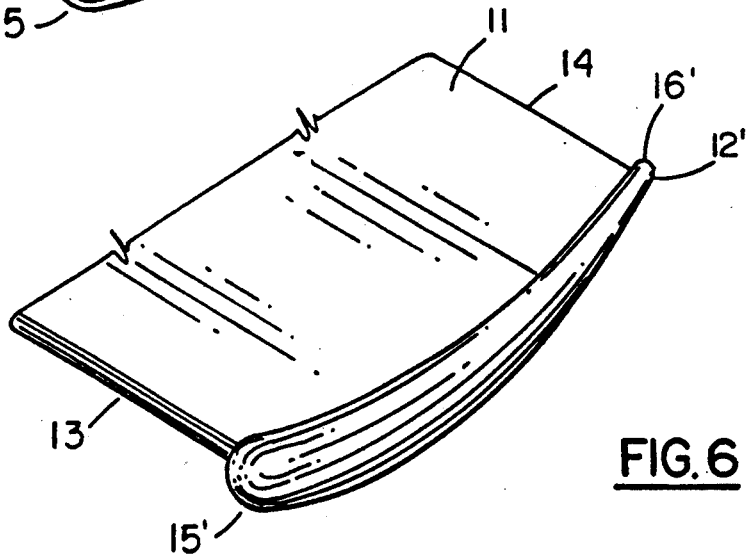

FIG. 6 depicts another embodiment of the present invention. In that embodiment, blade 11 is enhanced by body 12'. Similar to body 12, body 12', in planes passing through the axis of rotation of fan 10, has a generally circular cross section. The cross section is not constant for the length of body 12' but rather tapers smoothly up from leading end 16' to trailing end 15'. Both leading end 16' and trailing end 15' are aerodynamically faired.

What is claimed is:

1. An enhanced blade (11) for an axial flow fan, said blade having a leading edge (13), a trailing edge (14) and a tip having a tip contour that is an arc of the circle that defines the swept area of said fan, the enhancement comprising:

a rounded body (12') extending from said blade tip from said leading edge to said trailing edge, conforming to said tip contour and having a generally circular longitudinal cross section, a faired leading end (16') and faired trailing end (15') and a cross sectional area that increases from said leading end to said trailing end.

* * * * *